US007467647B1

(12) United States Patent
Wilk

(10) Patent No.: US 7,467,647 B1
(45) Date of Patent: Dec. 23, 2008

(54) PROCESS FOR MANUFACTURING SHOE LACES HAVING DESIGNATED FEATURES

(76) Inventor: Kelly A. Wilk, 8603 Ibis Cove Cir., Naples, FL (US) 34119-7728

( * ) Notice: Subject to any disclaimer, the term of this patent is extended or adjusted under 35 U.S.C. 154(b) by 0 days.

(21) Appl. No.: 12/002,440

(22) Filed: Dec. 17, 2007

Related U.S. Application Data

(63) Continuation-in-part of application No. 11/139,050, filed on May 27, 2005, now Pat. No. 7,309,235.

(51) Int. Cl.
*D03D 3/00* (2006.01)
*D03D 3/02* (2006.01)
*D03D 37/00* (2006.01)
*D03D 35/00* (2006.01)

(52) U.S. Cl. ..... 139/387 R; 139/23; 139/59; 139/390

(58) Field of Classification Search ..... 139/16, 139/22, 23, 59, 387 R, 390, DIG. 1
See application file for complete search history.

(56) References Cited

U.S. PATENT DOCUMENTS 1,397,299 A * 11/1921 Smith ..... 87/17
1,499,732 A * 7/1924 Hausberg ..... 87/17
1,499,830 A * 7/1924 Krissiep ..... 87/37
1,717,215 A * 6/1929 Otto ..... 87/2
1,885,749 A * 11/1932 Mehler ..... 87/2
1,887,643 A * 11/1932 Otto ..... 87/2
1,944,815 A * 1/1934 Schuler ..... 87/14
1,978,259 A * 10/1934 Gustav ..... 87/2
2,022,350 A * 11/1935 Otto ..... 87/2
2,072,542 A * 3/1937 Conrad et al. ..... 66/172 E
2,129,504 A * 9/1938 Prindle ..... 139/420 R
2,333,340 A * 11/1943 Rickenbacher ..... 156/245
2,376,442 A * 5/1945 Mehler ..... 87/9
2,681,667 A * 6/1954 Slaughter ..... 139/387 R
4,252,871 A * 2/1981 Sundberg ..... 429/140
5,792,555 A * 8/1998 Bak et al. ..... 428/373
6,412,386 B1 * 7/2002 Tseng ..... 87/9
7,051,460 B2 * 5/2006 Orei et al. ..... 36/84
2001/0013233 A1 * 8/2001 Motoya ..... 66/85 R
2005/0081402 A1 * 4/2005 Orei et al. ..... 36/45
2005/0146076 A1 * 7/2005 Alexander et al. ..... 264/257
2007/0089621 A1 * 4/2007 Kimball et al. ..... 101/127

OTHER PUBLICATIONS http://en.wikipedia.org/wiki/Textile_manufacturing; entire document.*
http://en.wikipedia.org/wiki/Dyeing, entire document.*
http://thepremiercoporation.com/fabrics.html, entire document.*

* cited by examiner

*Primary Examiner*—Bobby H Muromoto, Jr.
(74) *Attorney, Agent, or Firm*—Doonan Dwight McGraw

(57) ABSTRACT

The process includes steps for using raw yarn; dying the yarn; drying the dyed yarn by heating it; using the yarn in an appropriate loom machine such as a Jaquard loom or a needle loom to form concentrically-tubed shoe lace stock having a ridge on its outer tube; cutting the stock into desired shoe lace lengths; tipping the ends of the shoe lace lengths; inspecting the shoe laces; and placing the acceptable shoe laces in one area and the rejected shoe laces in another area. The objective of using the process is shown as variations of special shoe laces.

17 Claims, 2 Drawing Sheets

PROCESS FOR MANUFACTURING SHOE LACES HAVING DESIGNATED FEATURES

This application is a continuation-in-part. Priority is claimed based on the disclosure in U.S. patent application Ser. No. 11/139,050, which will issue as U.S. Pat. No. 7,309,235 on Dec. 18, 2007; and which claimed priority based on the disclosure in U.S. patent application Ser. No. 10/035,104, filed Jan. 3, 2002, now abandoned, both of those applications having been filed by the inventor of the claimed process herein disclosed.

BACKGROUND OF THE INVENTION

Over many years, there have been various processes and equipment that make shoe laces, which typically are woven using cotton or synthetic yarns, or combinations of various types of yarns, in either a flat or round shape and have ends provided with tips, usually made of a suitable plastic, which prevent the shoe laces from unraveling and provide lace ends which are easy to insert through shoe eyelets or similar shoe lace arrangements. When it was needed to have shoe laces such as those shown and claimed in the inventor's soon-to-be-issued U.S. Pat. No. 7,309,235, it was found by the inventor that some of the foremost shoe lace manufacturers, located in the U.S. as well as in some foreign countries, did not know how to make them. She finally located two shoe lace manufacturers who somewhat reluctantly tried her process for her, and found that it worked extremely well.

SUMMARY OF THE INVENTION

The invention relates to one or more processes in which previously-unknown shoe lace structures, such as those shown in the above-cited application that is soon to issue as U.S. Pat. No. 7,309,235, are to be made, as well as other similar shoe laces that have the features of primary interest. Equipment to be used generally presently exists, but have not been previously used by employing the one or more processes set forth so as to successfully manufacture the subject shoe laces that are particularly constructed to help very young children learn how to tie their own shoe laces.

DETAILED DESCRIPTION OF THE INVENTION

Figure 1:
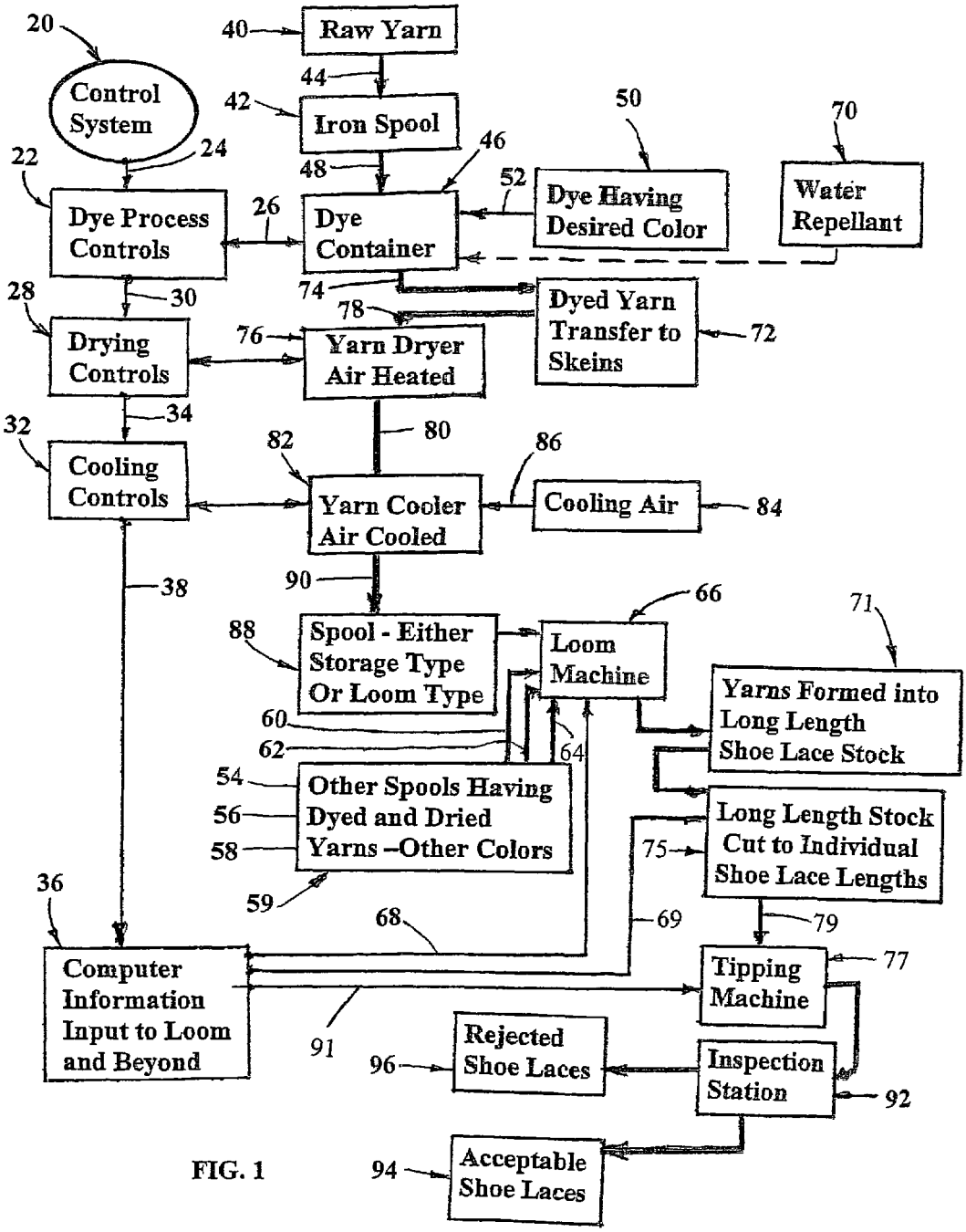
FIG. 1 is a schematic representation of the process embodying the invention herein disclosed and claimed.

The various equipment used when employing the inventive process or processes herein disclosed and claimed includes most or all of the equipment devices set forth schematically in the drawing.

FIG. 1 shows all elements and steps that can be used in the inventive method very schematically, in blocks identified as to what the block represents. There is a control system 20 that has four successive actions on defined parts of the process herein disclosed and claimed. The first element or action of control system 20 is illustrated by block 22, identified as "Dye Process Controls." The directional arrow 24 shows that the Control System of block 22 acts in accordance with the direction and recipient indicated by that the head of arrow 24.

The second element or action of control system 20 is illustrated by block 26, identified as "Dryer Process Controls" and directional arrow 28 shows the continuity and order of the controlled steps that are identified in the control blocks such as indicated by that arrow 28.

The third element or action of control system 20 is illustrated by block 30, identified as "Cooling Controls". Blocks 26 and 30 are connected by directional arrow 32, indicating another function of the control system 20 as another or steps of the process takes place.

The fourth element of the Control System 20 is indicated by block 34, which is identified as "Computer Information Input to The Loom and Beyond." The directional arrow 36 connects the blocks 30 and 34, with the controls of the loom being active to instruct the Loom Machine, the Tipping Machine, and the Inspection Station to be described.

Each yarn to be used is preferably raw yarn 40 that has not been dyed to color. In order to dye each yarn to a specific desire color, each yarn is placed on a spool 42 as indicated by arrow 48. Spool 42 is preferably made of iron, for reasons set forth below. Such spools are commonly referred to as Iron Spools. Iron Spools of this type are well known. Spool 42 has many holes through which the colored dye can be received by the yarn on the spool. These holes also help all of the yarn 40 on the spool 42 to absorb the dye with which each yarn is to be colored, and particularly so when the spool is being rotated within the dye. While plastic spools can be used, they have a tendency to crack and break after only a few times being used. Therefore, the metallic spools are desirable for economic purposes and better functionality.

The one or more spools 42 containing raw yarn 40 that is to be dyed one particular color is immersed in a dye container 46, as indicated by arrow 48. The liquid dye 50 to be used has already been placed in the dye container 46, as indicated by arrow 52. Usually, the spool or spools are rotated to speed up the dying step. This rotation may also be sensed and data relative to that rotation, as well as date relating to conditions of the dye such as the dye temperature and the amount of dye remaining in the dye container 46. At times its thickness relative to its viscosity can also be sensed, if that is something to be concerned about. It is to be understood that a number of separate spools are used for each yarn to be dyed a different color. These separate spools 54, 56, and 58 are shown schematically as, and identified as, a group in the schematic block 59. They are schematically shown, by arrows 60, 62, and 64, to be positioned in the Loom Machine 66 before that machine begins to process the various yarns into shoe laces. While three such spools are identified, it is to be understood that there may be more or less spools used within the Loom Machine 66 at any one time, depending upon the number of colors of yarn to be used in making the shoe laces. The range of colors is only limited by the numerous shades, tones and other characteristics of colors that one can imagine and desire to use. Since the yarns may be made of any of several types of yarn material, including, by way of example and not by way of limitation, polyester, cotton or other organic filaments that have been made into yarn, the process's dying time while located in other filled dye containers having different dye colors therein.

Each dyeing step is controlled by the ability of such yarns to accept the dye by absorption, and such controls are transmitted from the Control System's Dye Process Controls 22 to the Dye Container 46 by arrow 26, and the information about the status of the dye in the Dye Container 46 is fed back to the Dye Process Controls 22. Such information may include the temperature of the dye, the speed of rotation of the spool 42, and sensors that sense certain characteristics of the dye itself.

The particular dye used for a particular color and brightness is chosen from a cache of dye formulas that may typically have as many as 1,000 or more possible different colors, categorized by shade, brightness and the dye or dye components used to make one particular dye, usually identified by color, at least generally. These dye formulas are typically kept on a computer, and often are considered to be trade secrets of the dye trade. Once a particular color having particular characteristics for the shoe lace that is to made, the dye 50 is precisely created from the ingredients required to make the desired color of the dye to be used.

For an explanation of the process herein disclosed and claimed, it is considered sufficient to diagrammatically disclose only one raw yarn 40 to be colored by a chosen dye 50 that produces the chosen dye color when the yarn 40 has been dyed and dried. At this time the yarn is no longer considered to be raw yarn.

When the shoe laces to be made are to be waterproofed, a water repellant 70 of a known type may be used together with the dye, or sometimes after the drying process is completed. It depends primarily on the particular waterproofing compound is to be used. The repellant is schematically shown to be placed in the Dye Container 46 by dashed line 68. The dashed line represents the fact that the repellant is optional, and may be applied to yarn in another part of the process.

In one arrangement, the yarn is reeled off of the spool 42 and pulled through the particular dye that has been chosen and placed in the Dye Container 46, as is illustrated by line 48. The period of time that any one part of the yarn actually spends in the dye is determined by the Dye Process Controls 22. This is accomplished by varying the speed at which the yarn is removed from the spool and then passes through the dye. In another arrangement the yarn, still on the spool, remains on the spool as the dying process is continued. After it has absorbed the dye, the now-dyed yarn, as indicated by line 74, is hung up in loose skeins in preparation for the drying process, as indicated in block 72.

The yarn, still in the form of skeins, is transferred to a drying station 76, as indicated by line 78, once its dying process has been completed. The yarn is then heated in the dryer by the use of heated air being blown through the yarn skeins, at a desired temperature which dries the dye and fixes the particular color in the yarn. If the waterproofing compound has been applied with the dye, it will also become fixed. The drying station is controlled by the Drying Process Controls 22 of the Control System 20 spools 54, 56, and 58, shown as being in one block 59 in FIG. 1, so that the yarn is dried at a temperature and for a set time depending upon the material of which the yarn is made, and the particular compounds in the dye used. By way of example but not of limitation, polyester yarn is dried at a temperature that is preferably between 110° and 130° Centigrade. Other yarn materials may have a different drying range.

After the desired temperature of a yarn forming loose skeins is reached and maintained for a set period of time, the yarn, still in the form of a skein, is then subjected to cooling air, as illustrated by the blocks 82 and 84 of the drawing. The cooling air is shown as being directed to the cooling step by arrow 86. The air for cooling may be at normal atmospheric temperature. In extremely hot and humid atmospheres, however, the cooling air may be artificially cooled and dehumidified to the extent necessary to achieve a more normal atmospheric temperature such as about 27° Centigrade, and a relative humidity that is about 75% or less. The lower humidity will tend to decrease the actual time required to complete the cooling process, and a higher humidity will increase that time. The lower atmospheric temperature is used, with the understanding that it will also will have an increase in the humidity and that may decrease the drying time.

Once the yarns are dried, they may be either used in the Loom Machine 66 quite shortly, or are temporarily stored until they are later needed. If they are to be stored rather than being used immediately, the dried yarns are then transferred to a storage spool, which may be of iron, or a suitable hard plastic. This is noted in block 88 and by arrow 90, of FIG. 1. A storage spool that will serve as the spool for the loom machine 66 to be used can sometimes be used. If not, then the stored yarn on the storage spool has to be load onto the particular loom machine's spool, from which the yarn is taken for the chaining or weaving process performed in the loom machine. This is called "chaining" in that it is like a sewing chain stitch, where the yarn is transformed into a more finite form. There may be, and particularly for shoe laces, are, several chainings done in the making of one shoe lace.

In making the particular shoe laces of the type that is the subject of the above-noted U.S. application Ser. No. 11/159,050 and the about-to-be issued U.S. Pat. No. 7,309,235, the chaining operations form, from the yarns supplied to a loom machine on the spools holding yarns with all of the colors to be used in the finished product, a first tube within a second tube within a third tube, starting with the innermost tube being formed first. The outermost tube is the last tube formed. Of course, it is not a requirement that three, and only three, such tubes are made for each shoe lace, but that number of tubes making up the shoe lace seems to be the best for the special uses of these particular shoe laces, as noted in the referenced U.S. patent application Ser. No. 11/159,050. Depending to some extent on the particular yarn size being used, there can be a lesser number that three tubes, on a greater number of such tubes, in order to provide a sufficiently large shoe lace that youngsters can easily manage them with their fingers. One of the disclosed shoe laces to be made is made using two tubular parts. Part of the teaching the children to tie their own shoe laces is to increase their manual dexterity and sense of feel as well as their visual senses. These particular shoe laces may be round, but are preferably oval, as shown as one of the shoe lace types shown in the referenced U.S. patent application Ser. No. 11/159,050. The linear ridge that is a part of those oval shoe laces is formed as a part of the outside tube. The same is also true of the annular rings or ridges that are in linearly spaced relation on a shoe lace. This construction of some such shoe laces is also shown in that patent application.

The loom machine that is to be used for this is usually one of two types. One, and the preferred type, is known as a Jacquard loom or machine that is programmable to do braiding or circular weaving, because the three shoe lace tubes are braided or circularly woven while the chaining process is being carried out. Another type is known as a needle loom.

Both types have a long history, with the Jacquard type having a very early version. Joseph Marie Jacquard, was a French silk weaver and inventor. He invented the basic Jacquard loom mechanism in 1804-5. That first version was controlled by recorded patterns of holes in a string of cards, and allowed what is now known as the Jacquard weaving of intricate patterns. Later weavers were some of the inventors that improved on the machine's presentation of the concepts by Mr. Jacquard.

In the last few years there have been great strides in improving the Jacquard concepts. With many features that were not available until recent years, such as computers controlling the weaving of the intricate patterns as well as the finished physical features of such specialty woven items as shoe laces. Many of these modern machines were developed recently in China, Japan and Korea, although some were developed in other countries, including the United States. There are several manufacturers offering Jacquard machines and needle loom machines. Examples can be found by looking at Global Sources, found on the internet as "globalsources.com." They include some made by Xiamen Ytai Industrial Co., Ltd. located at 11A Haiguang Building, Shuixian Road, Xiamen City, Fujian Province, China. More particularly, they have several different models of a "Computerized Jacquard Loom" that are available. Xiamen is only one of the companies that manufacture looms of various types for the trade. There also are numerous companies in the United States of America, Thailand and China that make shoe laces. They just do not make ones like the disclosure in the above-noted patent application, or similar shoe laces having the required features, and therefore do not practice the process of the invention herein disclosed and claimed.

Figure 2:
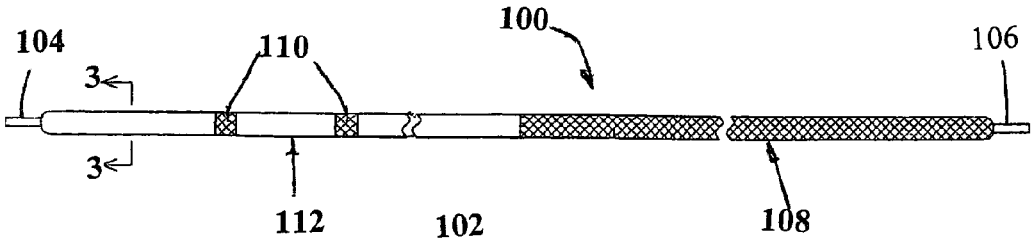
FIG. 2 shows one of the shoe laces of a type disclosed in the inventor's earlier-filed U.S. patent application Ser. No. 11/139,050, which will issue as U.S. Pat. No. 7,309,235 on Dec. 18, 2007, which is one of the products of the process herein disclosed and claimed.
Figure 3:
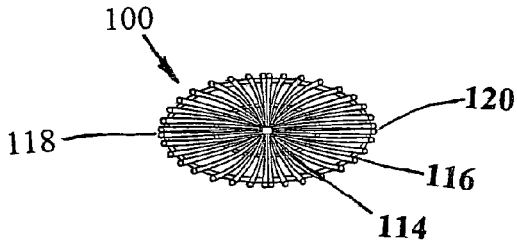
FIG. 3 is a cross-section view of the shoe lace shown in FIG. 2 taken in the direction of arrows 3-3 of that FIGURE.
Figure 4:
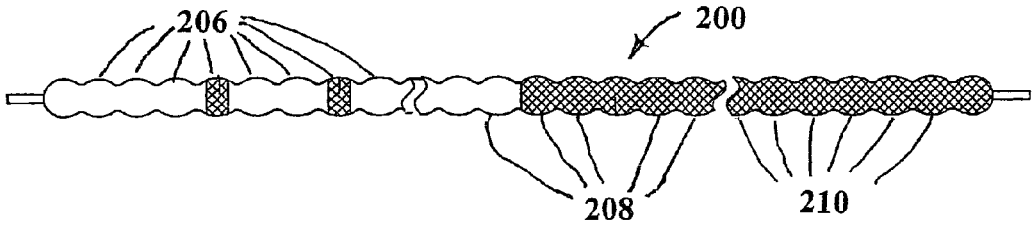
FIG. 4 shows another of the shoe laces of a type disclosed in that same application, and which is also one of the products of the process herein disclosed and claimed.

Once the basic long length shoe lace stock, as in block 71, of what will become shoe laces such as those shown in FIGS. 2, 3, and 4, and other similar ones, are made, they are transferred, as shown by line 78, and cut to length by the tipping machine as set forth in the drawing block 77. The shoe laces then have their ends provided with the tips. Such tips are shown as a part of the shoe laces illustrated in FIGS. 2 and 4. All this is preferably done with a tipping machine 77. Several manufacturers throughout the world make or have made or used tipping machines, and virtually all shoe lace manufacturers use tipping machines that are automatic. Runs can be made for a specific shoe lace length, and the tipping machines can then be reset to run a different length or lengths when needed, using the input from the Control System through the connection shown by arrow 91 that is able to make such major changes in the operation of the tipping machine 77.

Once tipped, each shoe lace passes through a quality control station, identified in the drawing as the Inspection Station 92, where they are inspected for the proper length, and for the tips that have been properly placed and secured to the opposite ends of each shoe lace. All shoe laces that meet the requirements are then routed to an area, identified in the drawing by the block 94 as Acceptable Shoe Laces, where such shoe laces are placed. Any shoe laces that do not meet the requirements are routed to a different placement area, identified in the drawing by the block 96 as Rejected Shoe Laces.

The Jacquard machines or looms are preferred when the chain-weaving of the particular shoe laces is complex. The special shoe laces can alternatively be made on a needle loom using the herein disclosed and claimed process. The Jacquard machine takes less time to set up and run them than does to set up and run the needle looms.

The shoe lace 100 shown in FIG. 2 has a body 102 extending between the tips 104 and 106 that have been placed thereon in the tipping machine 77. The oval cross-section shape of the shoe lace 100 is shown in FIG. 3. The detailed description of these shoe laces are found in the above-cited U.S. patent application Ser. No. 11/139,050. The approximately half of the shoe lace body 102, identified by the reference number 108, is shown as having a contrasting color to the remainder of the shoe lace body, as are the small ridges 110 which are spaced at defined points on the other half 112 of the shoe lace body. In some arrangements, the part of the shoe lace body 108, can also be a single small ridge relative to the other half 112 of the shoe lace body. Also, there is shown in FIG. 3 the oval shape of the shoe lace 100, and the concentric arrangement of two tubes 114 and 116 that make up the shoe body. The outer tube is tube 116. It has the small ridges 118 and 120 at the apogees of the body tube, as shown in FIG. 3.

The somewhat different shoe lace 200 shown in FIG. 4 has much more definite annular ridges 206, 208 and 210. The ridges 118 and 120 shown in FIG. 3 may also be a part of the shoe lace 200, but are not shown in this FIGURE.

The process herein disclosed and claimed may make shoe laces which have either one or both of the linear ridges shown in FIG. 3 extending along the entire length of shoe laces. Thus the process can be used to make some similar shoe laces that are not shown in the drawing, because the invention herein disclosed in FIG. 1, and described in detail above, being a process, does not require that all shoe laces to be made by it be shown; so long at their manufacture comes within the invention claimed, such manufacture is still covered by the claims herein set forth.

The invention claimed is:

1. A process of making shoe laces having a plurality of tubular layers including at least an inner tubular layer and an outer tubular Layer, and also having certain desired features such as color, shape, thickness, length, and at least one outer tubular layer ridge-like protuberance that extends outward from the outer tubular layer sufficiently to be felt by the fingers of a young child so that it is then usable to make each shoe lace easier to tie by very young children, said process having the following alphabetically-identified steps:

(A) installing raw yarn on a first plurality of spools on which raw yarn is to be dyed a specific selected color for each spool of raw yarn;

(B) placing each of said spools in a container of dye for dying the raw yarns on each of the spools a desired and specifically selected color;

(C) removing each of the spools having dyed yarn thereon from the container of dye;

(D) removing the dyed yarns from their spools and forming each of them into yarn skeins;

(E) placing each of the skeins of yarn in a warm air dryer and drying the yarns;

(F) cooling each of the skeins of dyed and dried yarns using cooling air;

(G) placing the dyed, dried and cooled yarns on a second plurality of spools;

(H) when the spools of step (G) are storage spools that are not also loom spools, moving the dyed, dried, and cooled yarns onto a third plurality of spools that are loom spools for use with a particular type of loom which may be at least either a Jaquard loom or a needle loom;

(I) selecting a yarn from which at least one ridge-like protuberance is to be woven in the shoe lace outer tubular layer concurrently with the other yarns so that it protrudes from the outer surface of the outer tubular layer;

(J) placing that selected yarn on another loom spool;

(K) placing the loom spools, on which the dyed, dried and cooled yarns and the loom spool holding the selected yarn of step (I) are received, into a loom machine so that all of the yarns are connected to appropriate parts of the loom machine in readiness for making tubular lengths of shoe lace stock with the outer layer thereof having the aforesaid protuberance formed on and extending outwardly from it;

(L) operating the loom using computer-generated directions to form in one continuing step the tubular lengths of shoe lace stock with the shoe lace stock having at least one of the shoe lace features in addition to color, including one or more of the protuberances, (M) removing the shoe lace stock from the loom machine and cutting the shoe lace stock into one or more precisely set shoe lace lengths;

(N) tipping the precisely set lengths of shoe laces to provide hard ends of each of the shoe laces; and (O) passing all cut and tipped shoe laces through an inspection station and inspecting all shoe laces for quality and sizing.

2. The process of claim 1 in which steps (K), (L), and (M) use a loom that is commonly known by those skilled in the art as a Jaquard loom.

3. The process of claim 1 in which steps (K), (L), and (M) use a loom that is commonly known by those skilled in the art as a needle loom.

4. The process of claim 1 in which step (I), in operating the loom using computer-generated directions, forms the at least one protuberance of a linear series of ridges extending longitudinally at least as substantial length parts of the completed shoe laces in spaced relation relative to the lengths of the shoe lace stock so as to have at least one spaced pair of the ridges being on each shoe lace after the shoe lace stock has been cut to individual shoe lace lengths.

5. The process of claim 1 in which, in beginning with step (I) through step (L), making the shoe lace stock made at of the completion of step (L) and more specifically making a concentrically spaced plurality of tubular shoe lace sections.

6. The process of claim 5 wherein the outer one of the tubular shoe lace sections is being formed by the process step (L) so that, as of the completion of step (L), at least one protuberance comprising a ridge that has been formed by step (L) on the completed shoe lace stock as a ridge extending linearly for a defined distance along each section of shoe lace stock that is of a length that is no more than the finished length of one the shoe laces to be made therefrom, and as a result, when the stock is cut to individual shoe lace lengths as set forth in step (M), there is at least one of the protuberances formed as a ridge located on each individual shoe lace length.

7. The process of claim 5 in which the number of tubular shoe lace portions is at least three.

8. The process of claim 6, in which the completion of step (M) results in the at least one ridge is at least two substantially parallel ridges that extend linearly for a distance that is no greater than the entire length of the finished shoe lace upon the completion of step (M).

9. The process of claim 6, in which the at least one ridge is at least two substantially parallel ridges that extend linearly for a distance that is no greater than the entire length of the finished shoe lace.

10. The process of claim 8 in which the completion of the step (L) results in the at least two parallel ridges being in substantial linear alignment with the length of the finished shoe lace stock.

11. The process of claim 8 in which the completion of the step (L) results in the at least two parallel ridges being in substantial right angles to the length of the finished shoe lace stock.

12. The process of claim 8 in which the completion of the step (L) results in the at least two parallel ridges being in substantial parallel alignment to each other and being at substantially right angles to the length of the finished shoe lace.

13. The process of making shoe laces particularly for use in instructing very young children how to tie their own shoe laces, said process comprising:

step (A): selectively preparing computer directed controls and using those controls to direct a Jacquard loom or a needle loom to form multi-tubular shoe lace stock that can be divided into a plurality of shoe laces, the shoe lace stock including at least an inner and an outer tubular shoe lace stock part made from selectively dyed yarns, and simultaneously doing step (B), which is forming at least one ridge along at least a linear portion of that length using at least one thread that extends along the length of the outer tubular shoe lace stock part, and in doing also forming the at least one ridge so that it protrudes from the outer tubular shoe lace stock part for a sufficient distance that it can be easily felt by one or more of the fingers of a young child as such child is using his fingers to grasp the shoe lace while learning how to tie his or her own shoe laces;

step (C): cutting the shoe lace stock part into individual same-length shoe laces;

and step (D): tipping the individual shoe laces formed by step (C).

14. The process of claim 13 wherein step (B) more specifically is forming the at least one ridge that comprises at least one linearly extending ridge.

15. The process of claim 13 wherein step (B) more specifically is forming the at least one ridge so that it comprises the protrusion of the at least one ridge that has a ring-like configuration so that it extends circumferentially about the outer tubular shoe lace stock part with the width thereof extending linearly on the shoe lace stock part.

16. The process of claim 15, wherein step (B) is forming a plurality of the circumferentially and laterally extending ridges.

17. The process of claim 16, wherein step (B) is forming at least two separate pluralities of the circumferentially and laterally extending ridges, and in do so is keeping the two separate pluralities of the circumferentially and latter extending ridges on opposite sides of the midpoint of the length of each shoe lace.

* * * * *